US005134905A

United States Patent [19]

Brennan et al.

[11] Patent Number: 5,134,905

[45] Date of Patent: Aug. 4, 1992

[54] BUNG REMOVAL APPARATUS

[76] Inventors: Allan T. Brennan, 409 N. Evans; Frank R. Sehon, 602 S. Roberts, both of El Reno, Okla. 73036

[21] Appl. No.: 756,511

[22] Filed: Sep. 9, 1991

[51] Int. Cl.[5] ..... B67B 7/42

[52] U.S. Cl. ..... 81/3.07; 81/124.3; 81/124.6; 81/177.2; 81/177.4; 53/381.4

[58] Field of Search ..... 81/3.4, 8.1, 3.05, 3.07, 81/121.1, 122, 124.3, 124.6, 124.7, 177.1, 177.2, 177.4, 177.5, 177.85, 3.29; 53/75, 367, 381.2, 381.4, 367

[56] References Cited

U.S. PATENT DOCUMENTS

| | | | |
|---|---|---|---|
| 2,940,229 | 6/1960 | Baker | 53/381.4 X |
| 3,613,332 | 10/1971 | Davis | 53/381.2 |
| 3,906,610 | 9/1975 | Hodgetts | 53/381.4 X |
| 4,132,052 | 1/1979 | Larson | 53/75 |

*Primary Examiner*—D. S. Meislin
*Attorney, Agent, or Firm*—Leon Gilden

[57] ABSTRACT

A tool is arranged for grasping a projecting bung structure relative to conduits typically buried in a subterranean orientation, wherein the tool includes a telescoping handle mounted to a central body, with the central body including a base plate. The base plate including a plurality of extension handles mounted to the base plate for securement within a leg handle mounted to an upper terminal end of the extension leg. A modification of the invention includes penetrating fluid solvent structure arranged for directing in a surrounding relationship relative to a base plate socket bore to project the solvent relative to a bung to be loosened for subsequent removal.

4 Claims, 4 Drawing Sheets

BUNG REMOVAL APPARATUS

BACKGROUND OF THE INVENTION

Field of the Invention

The field of invention relates to bung removal apparatus, and more particularly pertains to a new and improved bung removal apparatus wherein the same is arranged for receiving an upwardly extending bung relative to a subterranean pipe to permit ease of rotation of the bung at a remote orientation relative to the pipe.

Description of the Prior Art

Subterranean pipes, tanks, and the like are typically mounted at underground locations and are frequently of advanced age, such as twenty to thirty year old. Such pipes and tanks typically contain a threaded interconnection of an associated bung plug, wherein access to such plug structure is difficult and inter-reaction of soil relative to the bung structure typically results in rusted threads requiring sufficient leverage to remove the bung structure relative to the associated tank or pipe. The instant invention attempts to overcome deficiencies of the prior art by providing a tool structure arranged for permitting remote rotation of the bung projection.

Bung removal apparatus of the prior art has typically been of a relatively complex orientation to remove bung structure from associated containers when containers are easily accessed to an associated machine. Such machinery is exemplified in the U.S. Pat. Nos. 4,132,052; 3,906,610; 3,613,332; and 2,940,229.

As such, it may be appreciated that there continues to be a need for a new and improved bung removal apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bung removal apparatus now present in the prior art, the present invention provides a bung removal apparatus wherein the same is arranged to permit remote rotation of a bung structure when the bung is mounted within a tank structure in a subterranean orientation. As such, the general purpose of the present invention, which will be described subsequently in greater detail, is to provide a new and improved bung removal apparatus which has all the advantages of the prior art bung removal apparatus and none of the disadvantages.

To attain this, the present invention provides a tool arranged for grasping a projecting bung structure relative to conduits typically buried in a subterranean orientation, wherein the tool includes a telescoping handle mounted to a central body, with the central body including a base plate. The base plate including a plurality of extension handles mounted to the base plate for securement within a leg handle mounted to an upper terminal end of the extension leg. A modification of the invention includes penetrating fluid solvent structure arranged for directing in a surrounding relationship relative to a base plate socket bore to project the solvent relative to a bung to be loosened for subsequent removal.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bung removal apparatus which has all the advantages of the prior art bung removal apparatus and none of the disadvantages.

It is another object of the present invention to provide a new and improved bung removal apparatus which may be easily and efficiently manufactured and marketed.

It is a further object of the present invention to provide a new and improved bung removal apparatus which is of a durable and reliable construction.

An even further object of the present invention is to provide a new and improved bung removal apparatus which is susceptible of a low cost of manufacture with regard to both materials and labor, and which accordingly is then susceptible of low prices of sale to the consuming public, thereby making such bung removal apparatus economically available to the buying public.

Still yet another object of the present invention is to provide a new and improved bung removal apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
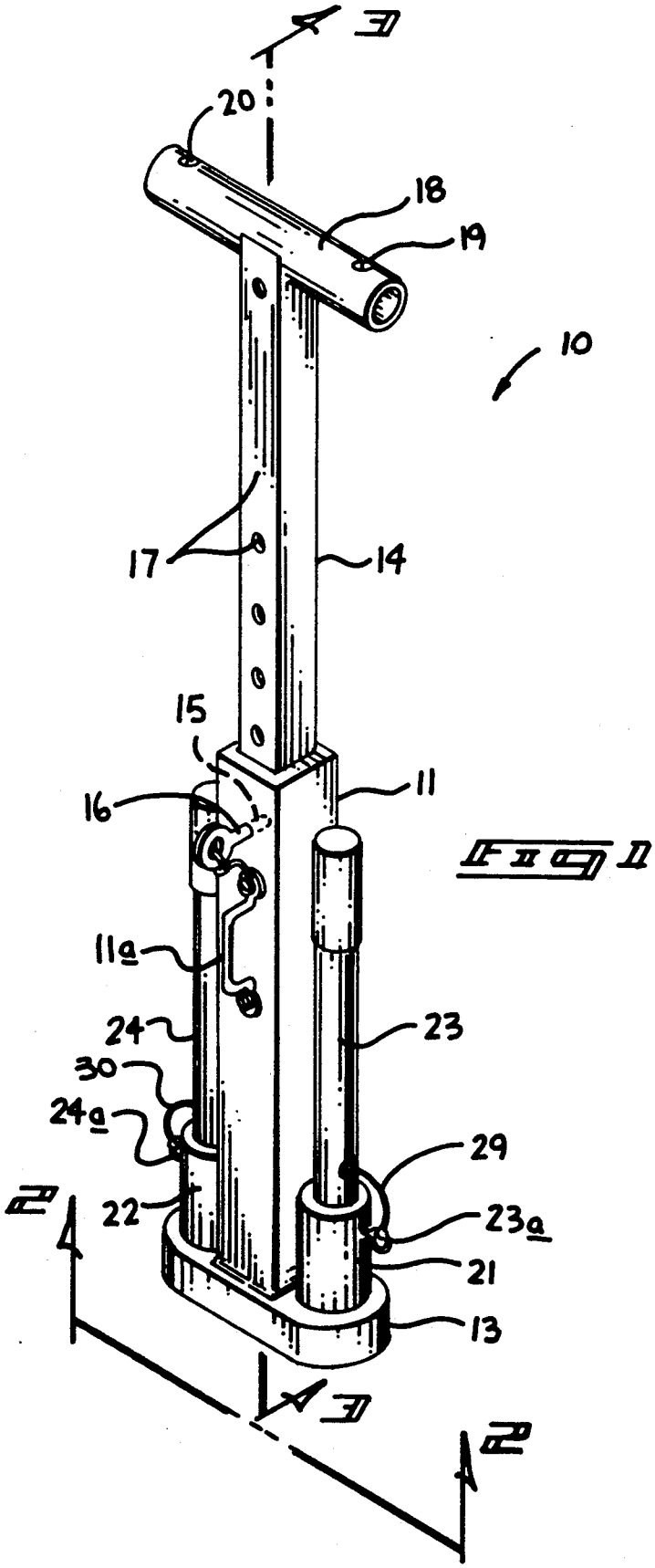
FIG. 1 is an isometric illustration of the instant invention.
Figure 2:
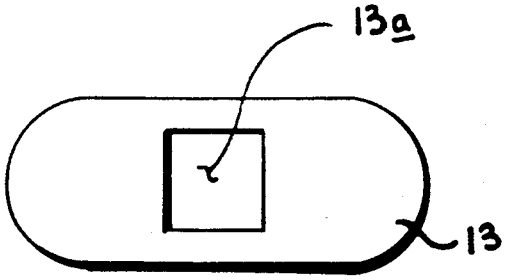
FIG. 2 is an orthographic view, taken along the lines 2—2 of FIG. 1 in the direction indicated by the arrows.
Figure 3:
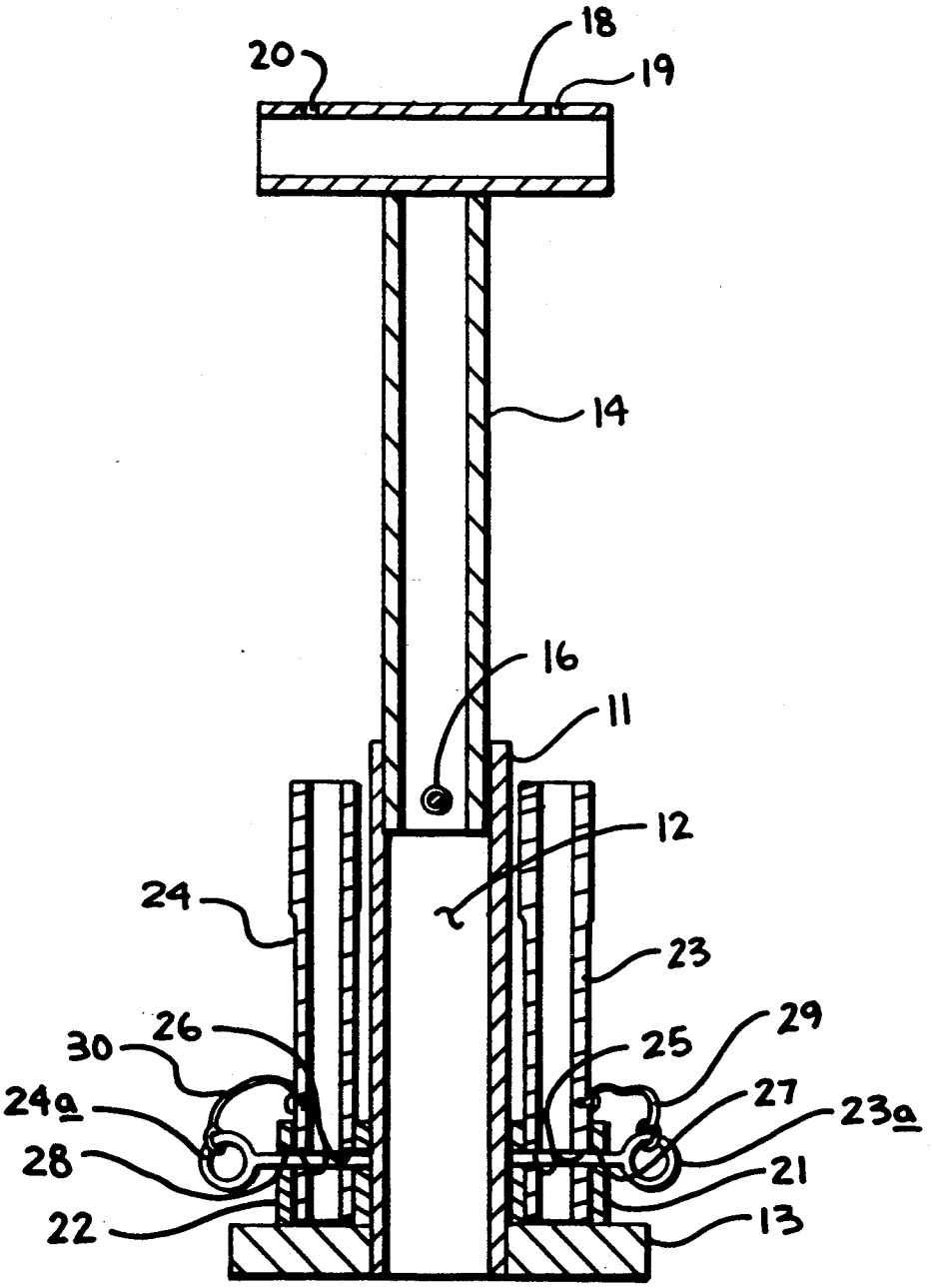
FIG. 3 is an orthographic view, taken along the lines 3—3 of FIG. 1 in the direction by the arrows.
Figure 4:
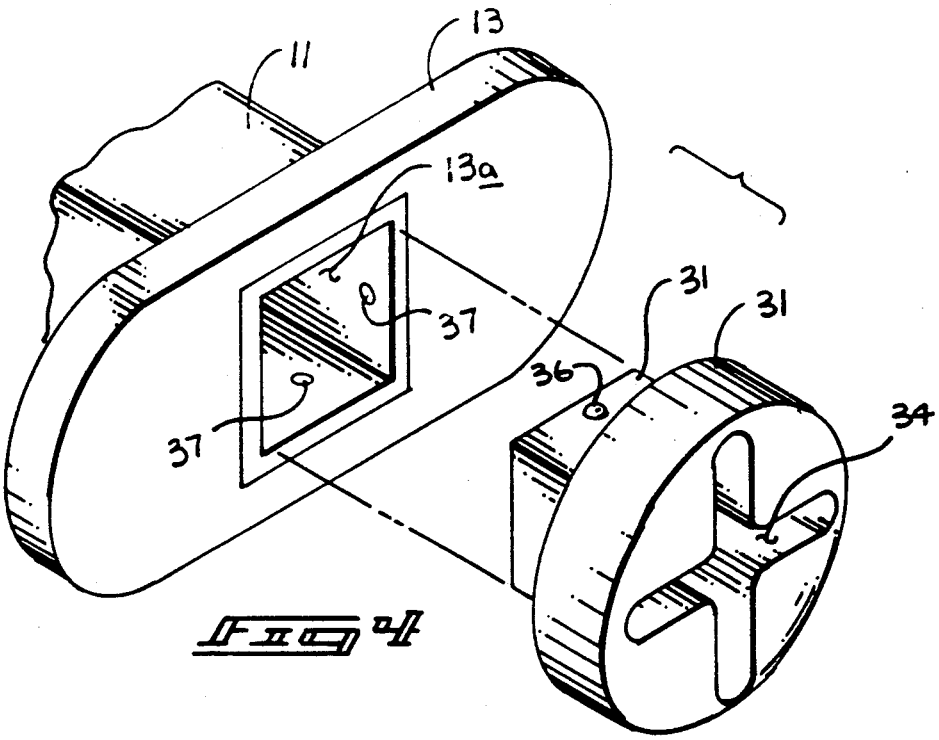
FIG. 4 is an isometric illustration of the tool utilizing an adapter head.
Figure 5:
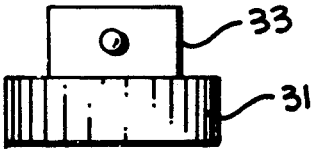
FIG. 5 is an orthographic side view of the adapter head.
Figure 7:
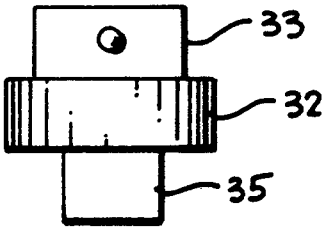
FIG. 7 is an orthographic side view of a further adapter head.
Figure 6:
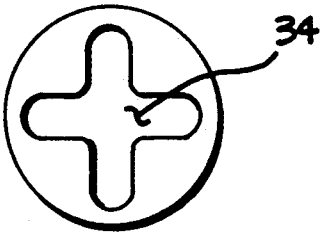
FIG. 6 is an orthographic bottom view of the adapter head.
Figure 8:
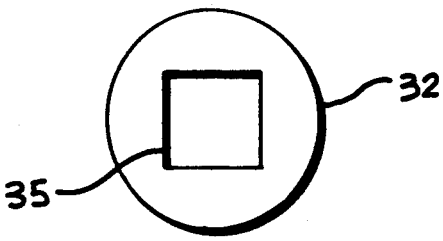
FIG. 8 is an orthographic bottom view of the further adapter head.

With reference not to the drawings, and in particular to FIGS. 1 to 11 thereof, a new and improved bung removal apparatus embodying the principles and concepts of the present invention and generally designated by the reference numeral 10 will be described.

More specifically, the bung removal apparatus 10 of the instant invention essentially comprises a tubular elongate body 11 of a generally parallelepiped configuration, including a tubular bore 12 directed coextensively through the tubular body 11. A base plate 13 is fixedly and orthogonally mounted to a lower terminal end of the tubular body 11 extending laterally beyond each side wall of the tubular body, including a base plate socket bore 13*a*, wherein the base plate socket bore is of a geometric configuration such as a square bore to receive a projecting boss of an associated typical bung structure. The square bore is coaxially aligned with the tubular body bore 12, whereupon rotation of the tubular body provides for symmetrical rotation about the socket bore 13*a*. An extension leg 14 is telescopingly mounted within the tubular 11, wherein a pin receiving body aperture 15 directed through the tubular body 11 adjacent an upper terminal end thereof receives a lock pin 16. The lock pin 16 directed through the body aperture 15 is then selectively aligned with one of a plurality of aligned extension leg apertures 17 directed through the tubular body 11 that are selectively and individually alilgned with the body apertures 15 to provide for a selective locking of the extension leg 14 relative to the tubular body 11, as illustrated in FIG. 1 for example, by use of the lock pin 16. A "U" shaped tubular body handle 11*a* mounted to a front wall of the tubular body permits ease of transport of the organization during periods of non-use.

A tubular leg handle 18 is fixedly and orthogonally mounted medially of its length to an upper terminal end of the extension leg 14. The leg handle 18 includes a right leg handle aperture 19 and a left leg handle aperture 20 directed through the leg handle 18 adjacent the respective right and left distal ends of the leg handle 18. A right and left tubular extension handle 23 and 24 are provided and mounted within respective right and left socket tubes 21 and 22 that are in turn fixedly mounted to a top surface of the base plate 13 adjacent opposed side walls of the tubular body 11. The right and left socket tubes 21 and 22 include respective right and left socket tube apertures 27 and 28 aligned with respective right and left extension handle apertures 25 and 26 that in turn receive respective right and left lock pins 23*a* and 24*a* of respective right and left tubular extension handles 23 and 24. The right and left lock pins 23*a* and 24*a* directed through the extension handle apertures 25 and 26 simultaneously with the socket tube apertures 27 and 28 lock the respective right and left extension handles 23 and 24 within the aforenoted socket tube apertures. Right and left tether lines 29 and 30 secure the lock pins 23*a* and 24*a* respectively to the respective right and left extension handles 23 and 24. In use, the extension handles 23 and 24 are removed from the socket tubes 21 and 22 upon removal of the right and left lock pins 23*al* and 24*a* from the socket tube apertures and the extension handle apertures. The right and left handles are thereafter directed into respective right and left distal ends of the tubular leg handle 18, wherein the extension handle apertures 25 and 26 are aligned with respective right and left leg handle apertures 19 and 20, whereafter the right and left lock pins 23*a* and 24*a* are directed into the right and left leg handle apertures 19 and 20 and right and left extension handle apertures 25 and 26. The FIGS. 4–8 illustrate the use of respective first and second adapter heads 31 and 32 that each include a respective mounting boss 33 to be complementarily received within the base plate socket bore 13*a*. Each respective first and second adapter head 31 and 32 includes a respective cross cavity 34, or boss plug 35, to accommodate various bung projections and recesses of various bung structures. Further, the adapter heads 31 include detent spheres 36 of a typical spring biased construction receivable detent sphere recesses 37 provided within the socket bore 13*a* to position and secure the respective adapter heads in use.

Figure 9:
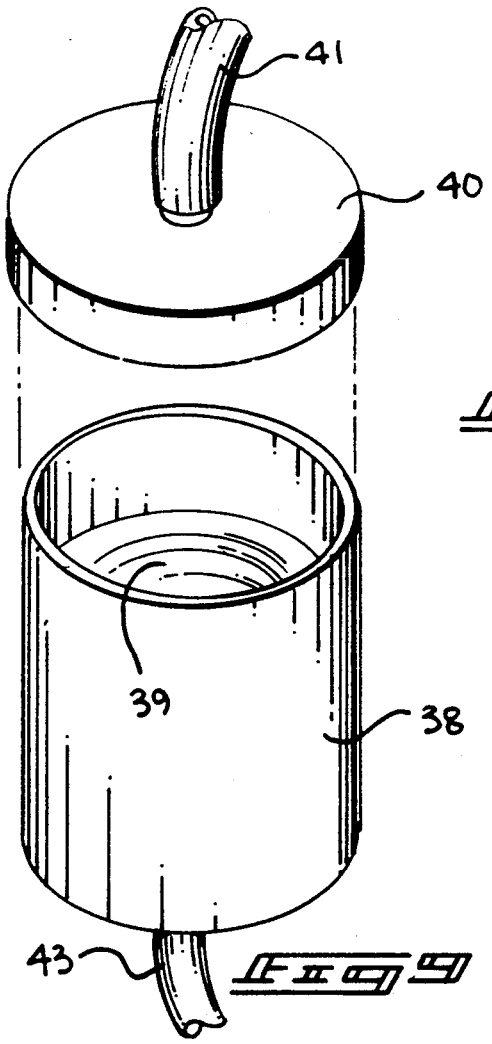
FIG. 9 is an isometric illustration of a reservoir utilized by a modification of the invention.
Figure 10:
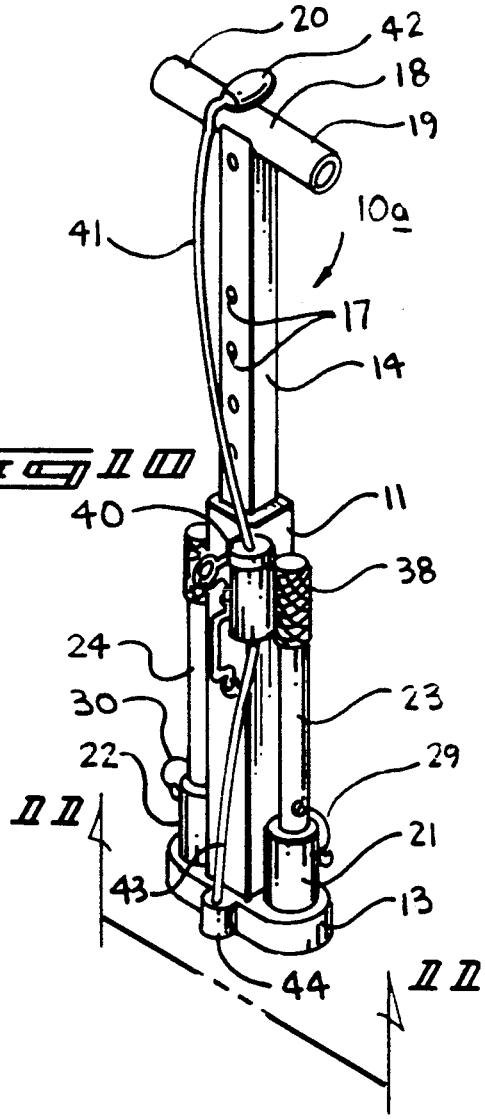
FIG. 10 is an isometric view of a modification of the invention.
Figure 11:
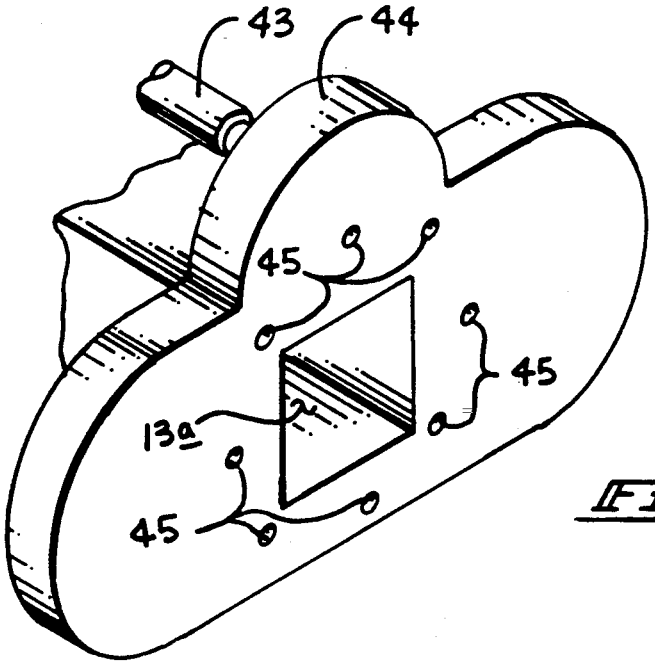
FIG. 11 is an isometric view, taken along the lines 11—11 of FIG. 10 in the direction indicated by the arrows.

Reference to FIGS. 9–11 illustrate the use of a modified apapratus 10*a*, including a reservoir 38 fixedly mounted to the tubular body 11 adjacent its upper terminal end, to include a solvent fluid 39 therewithin, wherein such solvent fluid is typically utilized in the penetration and freeing of rusted joints and the like. In this manner, the reservoir fluid is used to direct a portion of the solvent fluid 39 in a surrounding relationship relative to a bung to be removed (not shown) and to this end, a sealing cap 40 is mounted to an upper terminal end of the solvent fluid 39 to provide a pneumatic sealing container formed with a pneumatic conduit 41 directed into the sealing cap from a pressure bulb 42, whereupon compression of the pressure bulb 42 effects pressurization within the reservoir 38 and projects the solvent fluid 39 through a fluid conduit 43 directed through a bottom wall of the reservoir into a distribution boss 44 mounted to the base plate 13. A plurality of outlet ports 45 circumferentially positioned about the socket bore 13*a* projects the fluid in surrounding relationship relative to the socket bore to project a fluid relative to a bung member to be removed, wherein fluid communication between the distribution boss 44 and the ports 45 is provided.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bung removal apparatus, comprising, a tubular body of a generally parallelepiped configuration, including an elongate tubular body bore directed coextensively therethrough, and a base plate orthogonally mounted to a lower terminal end of the tubular body, with the base plate medially intersected by the tubular body, the tubular body including opposed respective right and left side walls, with the base plate extending laterally and orthogonally beyond the respective right and left side walls, and an extension leg telescopingly mounted within the tubular body, and the extension leg and tubular body including lock means for selectively locking the extension leg relative to the tubular body, and a tubular leg handle fixedly and orthogonally mounted to an upper terminal end of the extension leg, wherein the extension leg medially intersects the tubular leg handle, and the base plate including a right socket tube fixedly mounted to a top surface of the base plate adjacent the right side wall, and a left socket tube fixedly mounted to the base plate adjacent the left side wall, with each respective right and left socket tubes containing a respective right and left tubular extension handle, and the leg handle including a respective right and left entrance opening that are coaxially aligned relatively to one another and directed through respective right and left distal ends of the leg handle, wherein the right and left entrance openings receive the respective right and left tubular extension handles therewithin, and the base plate includes a base plate bottom surface, with the base plate bottom surface including a socket bore directed into the base plate, wherein the socket bore is coaxially aligned with the tubular body bore.

2. An apparatus as set forth in claim 1 including right lock means for selectively securing the right extension handle within the right socket tube, and left lock means for selectively locking the left extension handle within the left socket tube.

3. An apparatus as set forth in claim 2 wherein the tubular body includes a tubular body front wall and the front wall includes a "U" shaped body handle mounted to the front wall adjacent an upper terminal end of the tubular body for ease of transport of the apparatus.

4. An apparatus as set forth in claim 3 including a reservoir container mounted to the tubular body adjacent the upper terminal end of the tubular body spaced from the "U" shaped handle, the reservoir container includes a sealing cap mounted to a top of the reservoir container, and a fluid solvent contained within the reservoir, the sealing cap including a pneumatic conduit directed through the sealing cap and projecting upwardly thereof, wherein a free distal end of the pneumatic conduit includes a pressure bulb manually deformable to direct pneumatic pressure through the pneumatic conduit into the reservoir container, and a fluid conduit directed from the reservoir container in fluid communication with the fluid solvent, and the fluid conduit directed downwardly along the tubular body and directed into a distribution boss, the distribution boss fixedly mounted to the base plate, and the base plate bottom surface including a plurality of outlet ports circumferentially directed into the base plate in surrounding relationship relative to the socket bore, and each of the ports in fluid communication with the distribution boss and the fluid conduit to direct the fluid solvent in surrounding relationship about the socket bore when pneumatic pressure is directed into the reservoir container through the pneumatic conduit and the pressure bulb.

* * * * *